US006094809A

United States Patent [19]

Grassi

[11] Patent Number: 6,094,809

[45] Date of Patent: Aug. 1, 2000

[54] APPARATUS FOR SECURING A WHEEL RIM TO A SPIDER

[75] Inventor: John R. Grassi, Shaker Heights, Ohio

[73] Assignee: Alotech Ltd. LLC, Cleveland, Ohio

[21] Appl. No.: 09/131,425

[22] Filed: Aug. 10, 1998

Related U.S. Application Data

[62] Division of application No. 08/823,716, Mar. 26, 1997, Pat. No. 5,829,137, which is a continuation of application No. 08/415,626, Apr. 3, 1995, abandoned.

[51] Int. Cl.[7] ..... B23P 19/00

[52] U.S. Cl. ..... 29/802; 29/419.2; 72/56; 72/707

[58] Field of Search ..... 72/56, 707; 29/802, 29/419.2

[56] References Cited

U.S. PATENT DOCUMENTS

| | | | |
|---|---|---|---|
| 3,108,325 | 10/1963 | Harvey et al. | 72/56 |
| 3,345,844 | 10/1967 | Jansen et al. | 72/56 |
| 3,417,456 | 12/1968 | Carlson | 72/56 |
| 3,486,356 | 12/1969 | Brower et al. | 72/56 |
| 3,555,866 | 1/1971 | Roth . | |
| 3,896,647 | 7/1975 | Mikhailov et al. | 72/56 |
| 4,074,408 | 2/1978 | Davis . | |

FOREIGN PATENT DOCUMENTS

| | | |
|---|---|---|
| 0 028 393 | 5/1981 | European Pat. Off. . |
| 44 23 992 | 2/1995 | Germany . |
| 98/23400 | 6/1998 | WIPO . |

*Primary Examiner*—P. W. Echols
*Attorney, Agent, or Firm*—Fay, Sharpe, Fagan, Minnich & McKee, LLP

[57] ABSTRACT

A method for manufacturing a vehicle wheel includes the steps of providing a wheel rim and a spider and holding the spider inside the wheel rim. The wheel rim and the spider are positioned in a high capacity forming machine. At least one of a portion of the wheel rim located adjacent an outer periphery of the spider and a portion of the outer periphery of the spider is permanently deformed towards the other of the wheel rim and the spider thereby securing the wheel rim to the spider. An apparatus for securing the wheel rim to the spider includes a bottom die, a bottom inside rim stabilizer supported on the bottom die, a spider supported on the bottom inside rim stabilizer, a top inside rim stabilizer and a wheel rim supported by the bottom rim stabilizer and the top inside rim stabilizer. A high capacity forming machine encircles the wheel rim. The high capacity forming machine includes a workpiece which at least sometimes contacts the wheel rim and an electric circuit located adjacent the workpiece. A capacitor bank is electrically connected to the electric circuit of the high capacity forming machine. A switching circuit is electrically connected between the capacitor bank and the electric circuit for regulating a discharge of electricity from the capacitor bank into the circuit. The workpiece of the high capacity forming machine is capable of delivering a forming velocity of at least 10 m/second. A typical workpiece is either a resilient wall of an electrohydraulic device or a compression coil of an electromagnetic device.

13 Claims, 5 Drawing Sheets

APPARATUS FOR SECURING A WHEEL RIM TO A SPIDER

This application is a division of U.S. patent application Ser. No. 08/823,716 filed on Mar. 26, 1997, now U.S. Pat. No. 5,829,137. That application, in turn, is a continuation of U.S. patent application Ser. No. 08/415,626 filed on Apr. 3, 1995 and now abandoned.

BACKGROUND OF THE INVENTION

The present invention relates to a method of and an apparatus for manufacturing a vehicle wheel. More specifically, the present invention relates to a process and apparatus for securing a spider to a wheel rim. A "spider" can be defined as the beauty face of an auto wheel inside the wheel rim, or as the center dish or hub of a truck or vehicle wheel.

Vehicle wheels have usually been produced in one piece by methods such as casting or forging. They have also been produced in two or three pieces wherein either a one or a two piece rim is joined with a one piece spider by welding, bolting or riveting. However, all of these known processes are time consuming and fairly expensive. Welding is disadvantageous because it results in a reduced material condition in the heat-affected zone. Bolting or riveting is disadvantageous because non-uniform stress distributions are introduced at the annular joint between the wheel rim and the spider.

Manufacturers have, therefore, begun casting vehicle wheel spiders and forming the rim by spinning the rim from the spider to make a one piece wheel. But this process is time consuming and expensive. In addition, cast wheels have problems in use. Since they are relatively porous, they have a tendency to leak air when a tire without an innertube is mounted thereon. Also, they are not as shiny as the owners of vehicles desire their wheels to be. The industry is currently producing mostly one piece cast rims and two piece rims with a cast spider welded to a rim section formed by methods other than casting. In light of the problems with the conventional vehicle wheel manufacturing methods mentioned above, a need exists for better manufacturing processes for wheels.

There are several known special forming methods which are commonly referred to as high energy rate forming processes. These processes might be more accurately termed high velocity forming techniques. Such processes include explosive forming, electrohydraulic forming, electromagnetic forming and high velocity forging. Related high velocity forming techniques include stress peen forming and ultrasonic activated forming. These processes impart, through the application of high rates of energy transfer, a high velocity to and a high rate of strain to the material being formed. The forming velocity imparted to the material is generally equal to or greater than 10 m/second. The exact means used to achieve this high rate of energy transfer varies from process to process. The effect for most of these processes is, however, the same. The velocity component of the forming operation becomes very large and, in sheet metal forming, improved formability and closer tolerances can result. Chemical energy provided in the form of explosives, propellants or gas mixtures is used in the group of processes known as explosive forming. Large stores of electrical energy, released through high voltage capacitor discharge, are used in both electrohydraulic and electromagnetic forming. Mechanical energy is applied via compressed gas and high velocity hammers to perform operations such as high velocity forging and peen forming.

High energy rate forming processes are described in chapter 19 of volume 2 of the *Tool and Manufacturing Engineers' Handbook, Fourth Edition* published by the Society of Manufacturing Engineers. Volume 2 is entitled "Forming" and chapter 19 thereof is entitled "Special Forming Methods."

Because of the disadvantages listed previously in connection with the conventional methods of assembling vehicle wheels, such as welding, bolting, riveting, forging and casting, consideration has been given to some of the high energy rate forming processes as the method of manufacturing vehicle wheels.

It is known to apply the electromagnetic forming or magnaforming process in the manufacture of vehicle wheels. One patent disclosing this concept is U.S. Pat. No. 4,334,417 which teaches a wheel blank consisting of a circular flange surrounded by a split rim. The flange is placed between a pair of dies and the split rim is exposed around the periphery of the die. The dies together have an external face reproducing the profile of the intended wheel rim. When magnaforming is applied, the split rim is forced against the die external face in order to produce the rim of the wheel.

Another known process of manufacturing wheels which includes the step of magnaforming is disclosed in U.S. Pat. No. 4,592,121. In this process, a spider is secured to a wheel rim via conventional techniques and, after a tire is positioned on the rim, a final flange of the rim is formed by electromagnetic forming techniques.

However, neither of these known techniques has found wide commercial acceptance. Also, neither is useful in securing a spider to a wheel rim.

Accordingly, it has been considered desirable to develop a new and improved method of manufacturing a wheel and an apparatus therefor which would overcome the foregoing difficulties and others while providing better and more advantageous overall results.

BRIEF SUMMARY OF THE INVENTION

According to the present invention, a method is provided for manufacturing a vehicle wheel.

More particularly, the method comprises the steps of providing a wheel rim and a spider, holding the spider adjacent the wheel rim and positioning the wheel rim and the spider in a high capacity forming machine. At least one of a portion of the wheel rim located adjacent an outer periphery of the spider and a portion of the outer periphery of the spider is permanently deformed towards the other of the wheel rim and the spider thereby securing the wheel rim to the spider.

Preferably, the high capacity forming machine comprises a workpiece at least sometimes contacting the wheel rim and the step of deforming the wheel rim comprises the subsidiary steps of charging a capacitor bank electrically connected to a circuit of the workpiece and rapidly discharging the capacitor bank into the circuit, which then acts on the workpiece. If desired, the step of deforming can further comprise the subsidiary step of electrohydraulically driving the workpiece of the high capacity forming machine. Alternatively, the workpiece can comprise a coil body and the step of deforming can further comprise the subsidiary step of employing the coil body to generate a current within the rim causing a magnetic pulse in the wheel rim. Preferably the step of deforming comprises the subsidiary step of generating a velocity of at least 10 m/second in the at least one of the portion of the wheel rim and the outer periphery of the spider.

According to another aspect of the present invention, an apparatus is provided for securing a wheel rim to a spider.

More particularly in accordance with this aspect of the invention, the apparatus comprises a bottom die, a bottom inside rim stabilizer supported on the bottom die and a spider supported on the bottom inside rim stabilizer. A top inside rim stabilizer is located above the spider and a wheel rim is supported by the bottom rim stabilizer and the top inside rim stabilizer. A high capacity forming machine encircles the wheel rim. The high capacity forming machine comprises a workpiece which at least sometimes contacts the wheel rim and an electric circuit located adjacent the workpiece. A capacitor bank is electrically connected to the electric circuit of the high capacity forming machine. A switching circuit is electrically connected between the capacitor bank and the circuit of the high capacity forming machine for regulating a discharge of electricity from the capacitor bank into the circuit.

If desired, the high capacity forming machine can comprise an electrohydraulic device wherein the electric circuit comprises a pair of spaced electrodes, at least one of which is electrically connected to the capacitor bank and wherein the high capacity forming machine further comprises a die construction having a fluid storage cavity into which the pair of spaced electrodes extend and wherein the workpiece of the high capacity forming machine comprises a resilient planar member secured to the die construction and forming a wall of the fluid storage cavity. The electrohydraulic device can further comprise a plurality of tie down bolts for securing the resilient wall to the die construction. If desired, the electrohydraulic device can further comprise insulation encircling the electrode to electrically isolate the electrode from the die construction. Preferably, the resilient wall comprises an elastomeric material. Preferably the electrohydraulic device further comprises a fluid inlet conduit communicating with the fluid storage cavity and a fluid exhaust conduit communicating with the fluid storage cavity.

If desired, the high capacity forming machine can comprise an electromagnetic device wherein the workpiece comprises a coil body and the electric circuit comprises a compression coil. If desired, the high capacity forming machine can further comprise a field shaping body. Preferably, the high capacity forming machine further comprises a sensing circuit which receives information from the capacitor bank, a control circuit which receives information from the sensing circuit, a charging circuit which receives information from the control circuit and a limit and safety circuit which is regulated by the charging circuit and provides information to the control circuit.

One advantage of the present invention is the provision of a new and improved method for manufacturing wheels.

Another advantage of the present invention is the provision of a new and improved apparatus for securing a spider and a wheel rim to each other.

Still another advantage of the present invention is the provision of a high velocity forming method for securing a wheel rim and a spider to each other. By a high velocity forming method is meant generating a velocity of at least 10 m/second in at least one of the wheel rim and the spider so as to urge that element against the other of the wheel rim and the spider. The high velocity forming method can comprise electrohydraulic forming or electromagnetic forming.

Yet another advantage of the present invention is the provision of an apparatus which allows either an electrohydraulic or an electromagnetic forming of a wheel by compressing an annular portion of a wheel rim into an annular concavity formed between a pair of spaced annular projections on the radially outer periphery of a spider.

A further advantage of the present invention is the provision of a wheel including a wheel rim and a spider which can be made of dissimilar materials. These two elements can be successfully joined to each other by a mechanical interlock formed between them by a high velocity forming method.

A still further advantage of the present invention is the provision of a lighter weight vehicle wheel than conventional wheels for increasing the fuel efficiency of vehicles. The wheel is manufactured by a high velocity forming method.

A yet further advantage of the present invention is the provision of a vehicle wheel in which a wheel rim of the wheel can be replaced if it becomes damaged without also having to replace the spider of the wheel.

Still other benefits and advantages of the invention will become apparent to those of average skill in the art upon a reading and understanding of the following detailed specification.

BRIEF DESCRIPTION OF THE DRAWINGS

The invention may take form in certain structures and components which will be described in detail in this specification and illustrated in the accompanying drawings which form a part hereof and wherein.

DETAILED DESCRIPTION OF THE PREFERRED EMBODIMENTS

Figure 1:
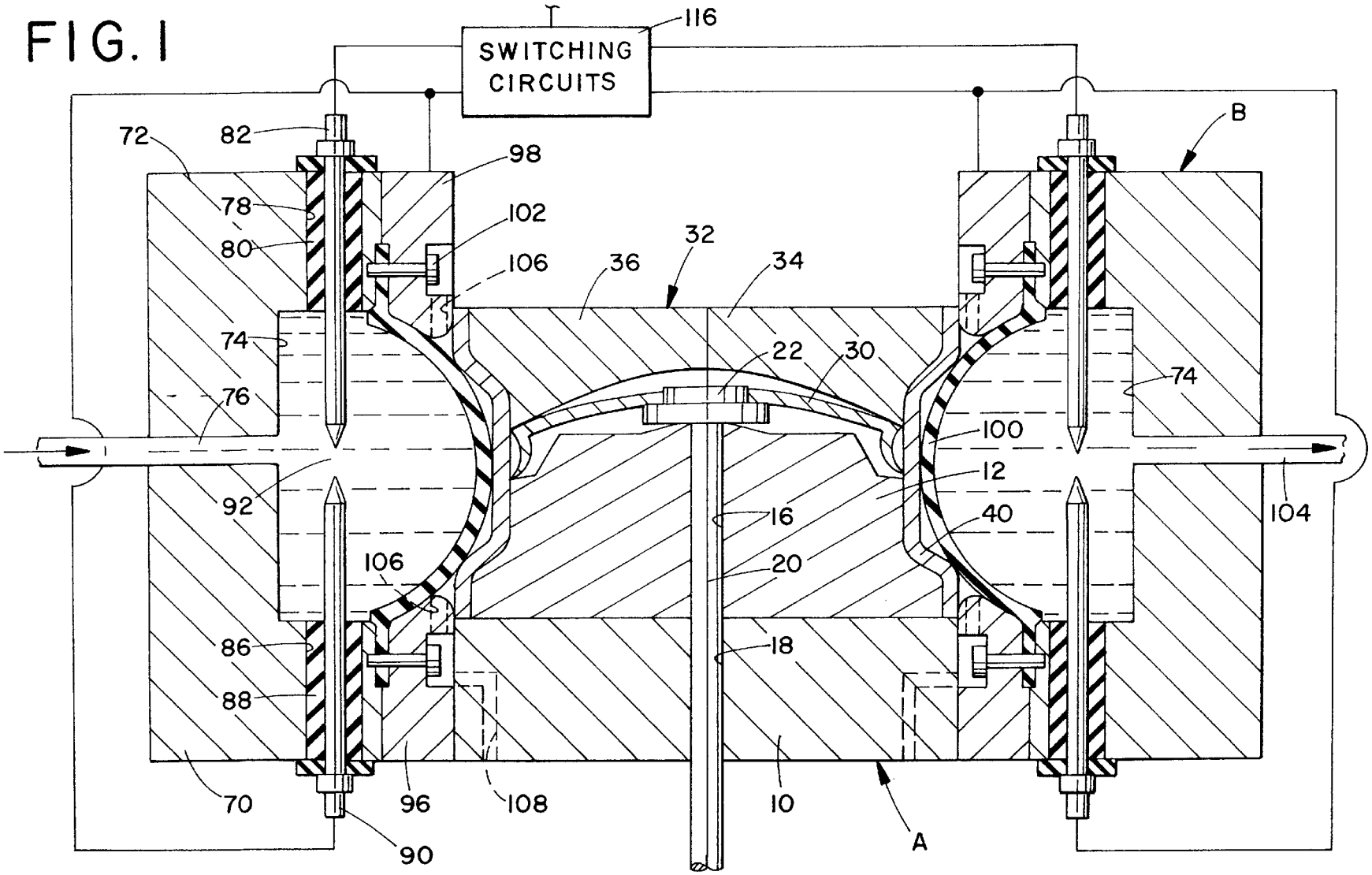
FIG. 1 is a schematic side elevational view in cross section of an electrohydraulic high capacity forming machine for securing a wheel rim to a spider according to the present invention.
Figure 7:
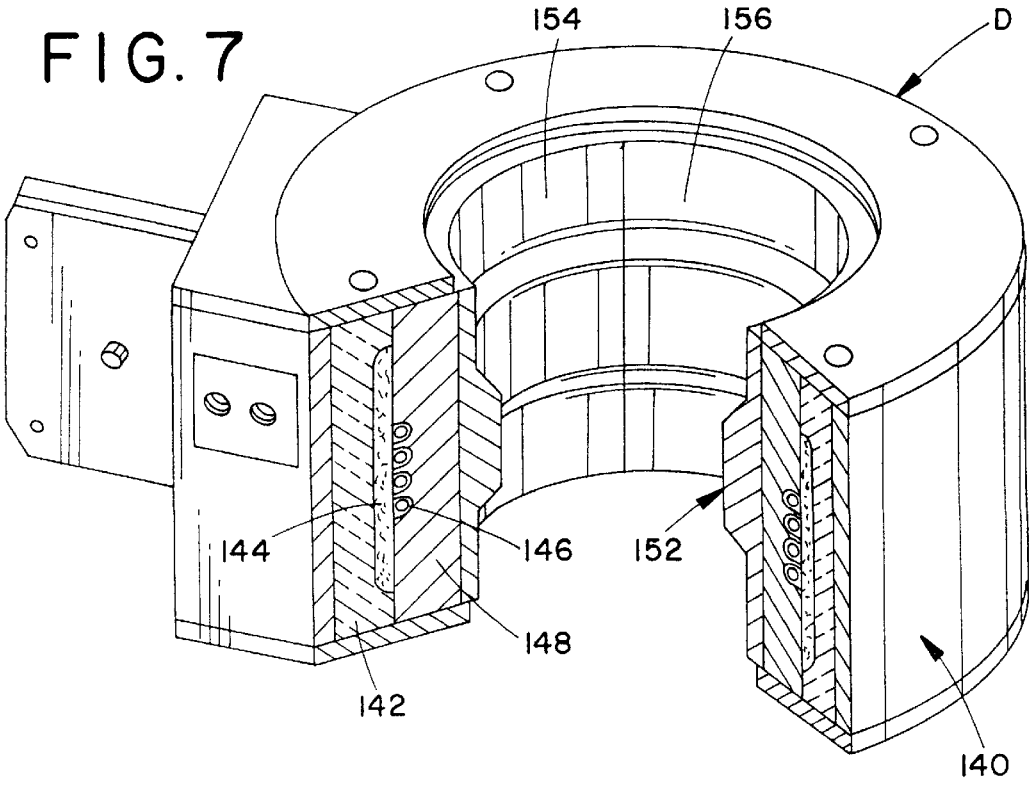

Referring now to the drawings, wherein the showings are for purposes of illustrating several embodiments of the invention only and not for purposes of limiting same, FIG. 1 shows an electrohydraulic forming machine for securing a wheel rim to a spider whereas FIG. 7 illustrates an electromagnetic forming machine for the same purpose. While the method and apparatus of manufacturing wheels is primarily designed for, and will hereinafter be described in connection with vehicle wheels, it should be appreciated by those of average skill in the art that the inventive method could also be practiced to manufacture a wide variety of other types of wheels. Also, while electrohydraulic and electromagnetic forming are specifically disclosed, other high energy rate forming processes such as explosive forming or high velocity forging could also be used to manufacture wheels.

A mechanical compressive interlock joint can be formed between a wheel rim and a spider by the several high energy rate forming processes mentioned. These each impart a high workpiece velocity to either the wheel rim or the spider. The high energy rate forming process utilizes the known relationship of metal springback and its dependence on strain rate. With increasing rates of strain, the amount of metal springback can be decreased, or even eliminated. The elimination of metal springback can cause a ring compressed radially to remain in compression allowing for an acceptable working joint. This material condition is the underlying basis of the high energy rate forming processes or high velocity forming techniques. A joint produced via compression allows tremendous processing flexibility in the fabrication of wheels. The size of a wheel created in this way is only limited by the equipment variables for imparting the necessary energy required to form the joint.

In a preferred embodiment of the high capacity forming machine, electrohydraulic forming is employed due to its non limiting feature of forming materials with either high or low electrical conductivity. However, as mentioned, any of the other high energy rate forming processes would be capable of producing a high velocity in the workpiece to create a compressed state in the joint to prevent separation. Therefore, any of the mentioned other high energy rate forming processes may also be acceptable.

Electrohydraulic forming is a process that converts electrical energy into mechanical energy for the forming of metallic parts. The amount of electrical energy discharged is controlled by varying a charging voltage. The discharged electrical energy causes explosions in a suitable fluid medium contained inside a hollow workpiece. These explosions produce shockwaves that radiate in all directions in the medium until some obstruction is encountered. If the energy is of sufficient magnitude, the workpiece, usually a flexible bladder secured over the fluid chamber, is deformed. The deformation of the workpiece is controlled by applying external restraints to the workpiece. Such external restraints may be in the form of dies. A major advantage of electrohydraulic forming is its ability to form hollow shapes that would normally require more expensive fabricating techniques.

With reference now to FIG. 1, a die assembly used for the method and apparatus according to the present invention includes a bottom die inner half 10 which supports a bottom die inside rim stabilizer 12. An aperture 16 extends transversely through the rim stabilizer 12 and is coaxial with an aperture 18 extending transversely through the bottom die inner half 10. A knockout rod 20 extends through the aligned apertures 16 and 18. The knockout rod has a centering plate 22 at its tip. The centering plate centers a spider 30 supported by the inside rim stabilizer 12. Located above the spider is a top inside rim stabilizer 32. This element comprises first and second sections 34 and 36 which can be separated from each other in order to allow the spider 30 to be positioned beneath them and in order to allow the wheel, once it is manufactured, to be removed from the die assembly A.

Resting on the bottom die inside rim stabilizer 12 and the top die inside rim stabilizer 32 is a wheel rim 40 having an indented central portion. It should be recognized that the wheel rim 40 and the spider 30 are only illustrated schematically in FIG. 1. As mentioned, the wheel is preferably a vehicle wheel, such as is more clearly illustrated in FIG. 4.

Figure 4:
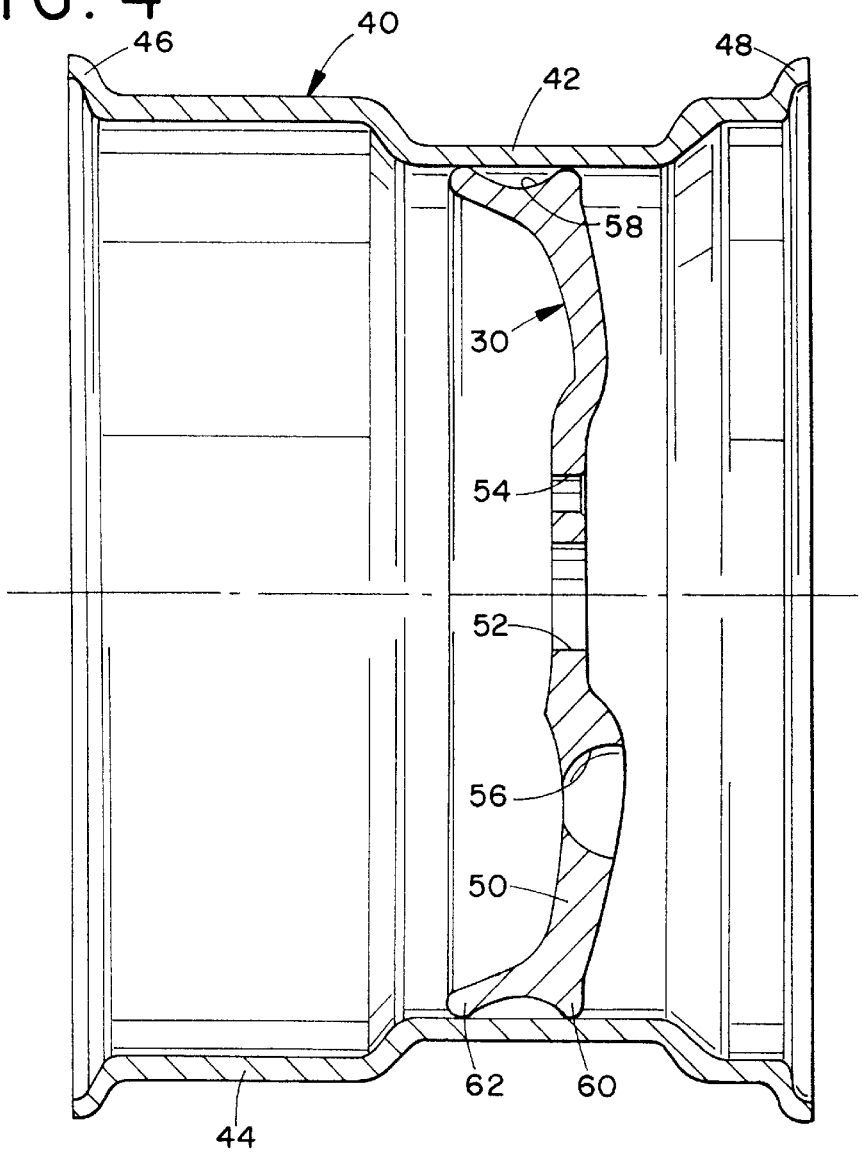
FIG. 4 is an enlarged side elevational view in cross section of a vehicle wheel rim and a spider before the two are secured to each other.
Figure 6:
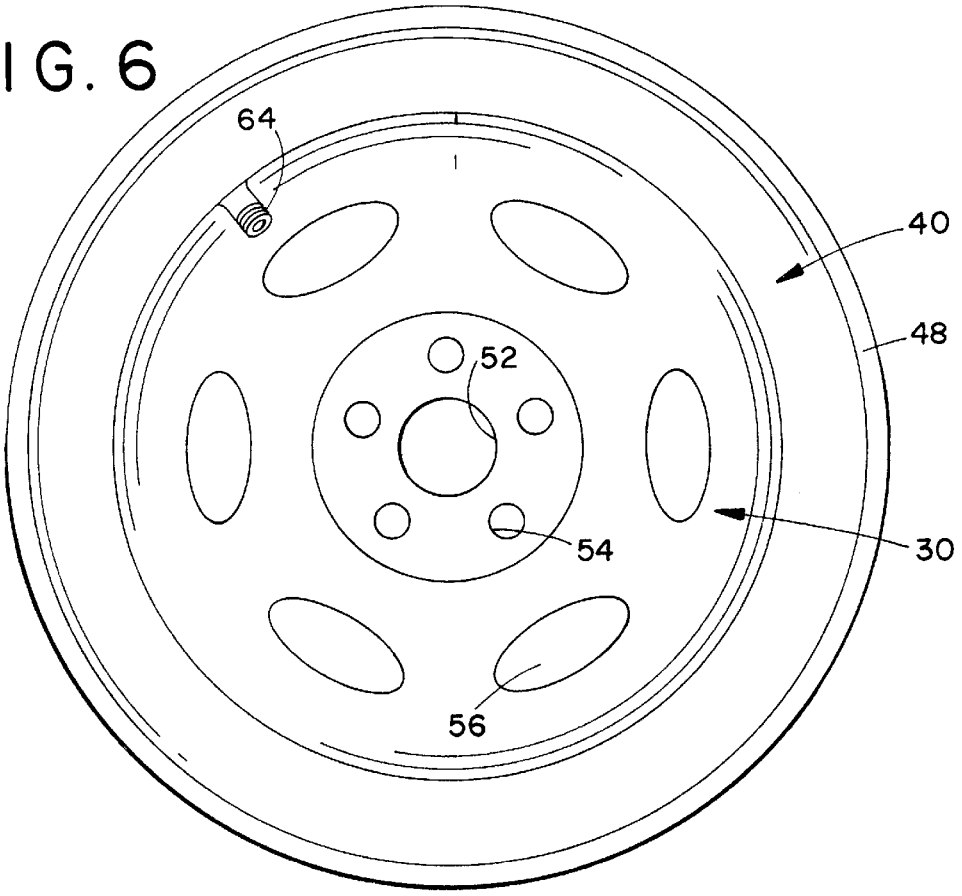
FIG. 6 is a front elevational view of the wheel of FIG. 4 after the wheel rim has been secured to the spider; and, FIG. 7 is a perspective view partially in cross section of an electromagnetic high capacity forming machine for securing a wheel rim to a spider according to the present invention.

With reference now to FIG. 4, the wheel rim 40 is cylindrical in shape and comprises an indented toroidal section 42 located in a cylindrical wall 44 of the wheel rim 40. Positioned on one end of the wall 44 is a first flange 46. Positioned on another end of the wall 44 is a second flange 48. Located inside the wheel rim 40 is the spider 30. The spider comprises a spider body 50 having a center hole 52 extending through the spider body and a plurality of bolt holes 54 extending through the spider body in a manner spaced from and surrounding the center hole, as is best illustrated in FIG. 6. Also provided in the spider body 50 can be a plurality of spaced decorative pockets 56 which may be of any suitable desired shape and depth. A radially outer periphery of the spider 30 is formed with an annular concavity 58 defined by a pair of spaced annular projections 60, 62. The projections contact an inner surface of the wheel rim indented toroidal section 42. Located at a defined point on the outer periphery of the spider 30 is a tire stem 64, as shown in FIG. 6. As is known, the tire stem extends through the wheel rim 40 to communicate with the interior of a tire (not shown) secured on the wheel between the flanges 46 and 48.

With reference now again to FIG. 1, a high capacity forming machine B surrounds the die assembly A. The forming machine comprises a lower outer major die half 70 and, supported thereon, an upper outer major die half 72. These two elements define between them a cavity 74 which communicates with a fluid inlet 76 to allow a suitable fluid, such as water, to flow into the cavity 74. It should be recognized that each of the die halves 70 and 72 is toroidal in nature. Therefore, the cavity 74 defined between them is also toroidal in form. A bore 78 extends transversely through the upper die half 72 from an upper periphery thereof to the cavity 74. Positioned in the bore 78 is a sleeve 80 surrounding a first electrode 82. The sleeve is made from a suitable insulating material, such as a conventional elastomer to insulate the electrode 82 from the die half 72. One such elastomer is a rubber material.

A bore 86 extends transversely through the lower major die half 70 from the outer periphery thereof to the cavity 74. Positioned in the bore is a sleeve 88 which encloses a second electrode 90 to electrically isolate it from the die half 70. The two electrodes extend into the cavity 74 so that their adjacent ends are spaced from each other by a desired gap 92. The high capacity forming machine B further comprises a lower outside lock ring 96 and an upper outside lock ring 98. These two trap between themselves and the adjacent lower and upper outer major die halves 70 and 72 a flexible wall or bladder 100 made of a suitable conventional elastomeric material. The wall 100 defines a flexible toroidal workpiece which selectively contacts the outer periphery of the wheel rim 40. In order to secure the wall 100 in place, suitable conventional torque bolts 102 are provided. A second bore 104 communicates with the cavity 74 in order to allow an outflow of fluid.

Air vents 106 are located in the upper and lower outside locking rings 96 and 98 in order to allow a venting of air therefrom when that becomes necessary. Air passages 108 extend through the bottom die inner half 10 and communicate with the lower air vents 106 to allow an outflow of air. The locking rings 96 and 98 also clamp the top and bottom ends of the wheel rim 40.

In the embodiment of FIG. 1, the electrical energy of the high capacity forming machine is converted to mechanical energy by the spark discharge method. In this method, a spark transducer is employed. The energy is discharged from the transducer when it jumps across the gap 92 located between the two electrodes 82 and 90 and vaporizes the liquid located in the gap.

It should be appreciated, however, that another method known in the art for converting the electrical energy into mechanical energy is the exploding bridge wire method (not illustrated). The exploding bridge wire method is advantageous from the standpoint that it is more efficient than the spark gap method. The exploding bridge wire method could be used to manufacture vehicle wheels. However, a disadvantage of this method is that a new wire must be installed on the electrodes for each successive use of the device thus increasing production time.

Figure 2:
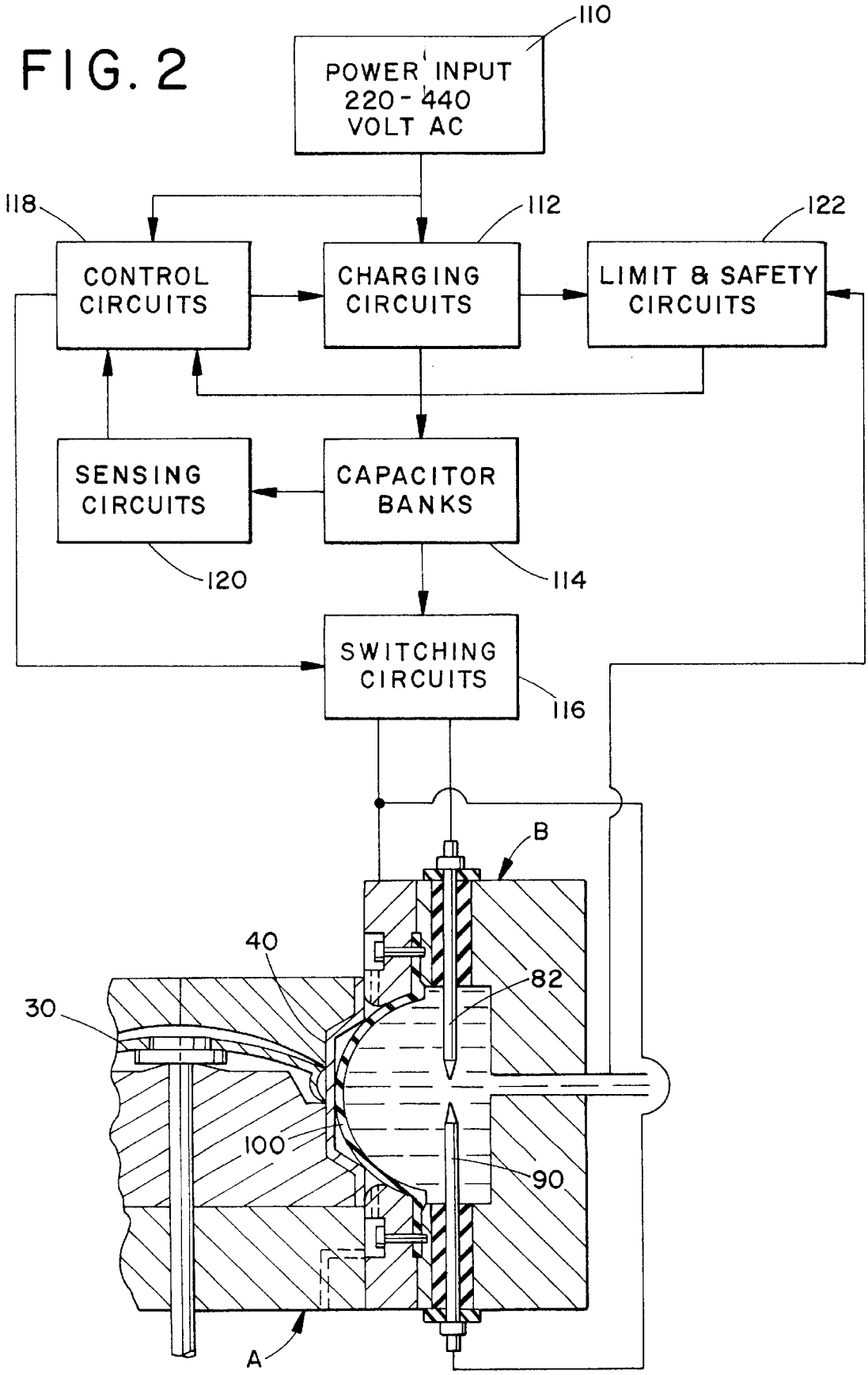
FIG. 2 is a schematic side elevational view, partially in cross section, of a portion of the electrohydraulic forming machine of FIG. 1 and an electrical circuit therefor.

With reference now to FIG. 2, the electrical components of the electrohydraulic forming system of FIG. 1 are there illustrated. These components comprise a high voltage power supply 110 which may be, e.g., a rectifier, charging circuits 112 and a bank of capacitors 114 which store the charge from the charging circuits. The capacitor banks are electrically connected to switching circuits 116 which regulate the discharge of the electricity from the capacitor banks through the electrodes 82 and to the electrodes 90. The energy capacity of such equipment is normally rated in kilojoules (wherein 1 kJ=738 ft-lbs) and ranges from 6 to 150 kJ or more. Maximum energy can usually be attained within 10–25 micro seconds.

Because electrohydraulic forming utilizes a liquid, normally water, as the medium for transferring pressure to the workpiece, the flexible bladder 100, and because of the speed with which the operation occurs, the air trapped between the workpiece and the wheel rim must be allowed to escape. The air vents 106 and passages 108 are provided for this purpose.

Figure 3:
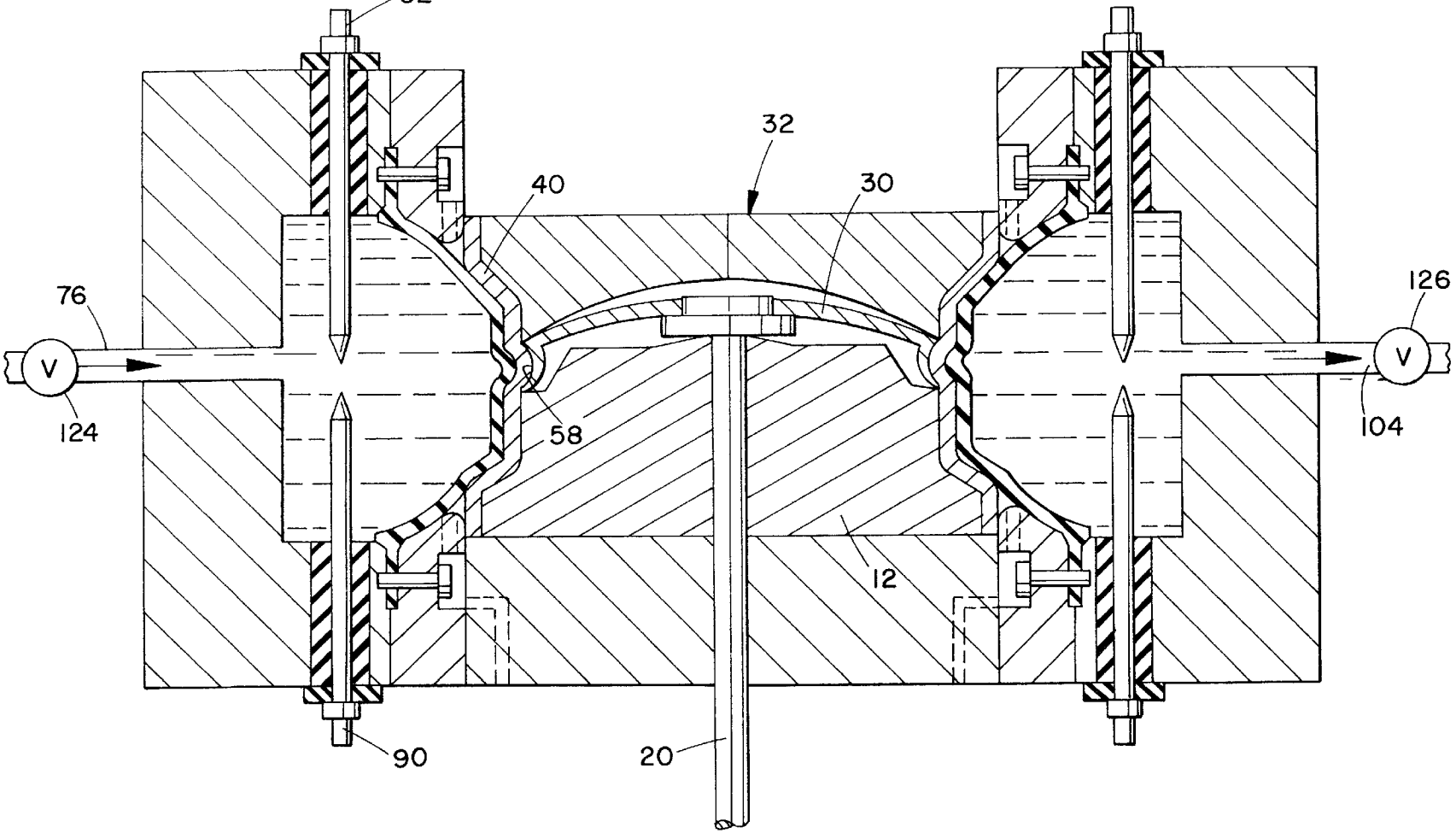
FIG. 3 is a schematic side elevational view in cross section of the electrohydraulic forming device of FIG. 1 while a bladder thereof is distended during the step of deforming the wheel rim to secure it to the spider.

While two sets of electrodes 82 and 90 are illustrated in the cross-sectional views of FIGS. 1 and 3, it should be appreciated that any suitable desired number of pairs of electrodes may be utilized in the toroidal fluid cavity 74 as may be needed for a particular forming operation. It is noted that the bladder 100 is distended by pumping liquid into the fluid cavity 74 until the bladder approaches the wheel rim 40 before the beginning of the electrohydraulic forming operation.

The material of the die is usually selected based on operations to be performed and the quality of parts to be produced. Low carbon steel is the most common die material used. However, if a very long die life is desired, a heat treated tool steel can be used. Dies for electrohydraulic forming could also be fabricated from epoxy casting resins since such dies are inexpensive to make and require little or no machining because they are molded to a pattern of the required shape. However, such dies are disadvantageous for the manufacture of vehicle wheels because they normally only last for only one or two dozen parts.

With reference now to FIG. 3, the wheel rim 40 is secured to the spider 30 by causing the switching circuits 116 to allow the electricity to discharge from the capacitor banks 114 into electrodes 82. The electricity then jumps the gap 92 to flow into the electrodes 90. When jumping the gap, a spark is formed between the electrodes 82 and 90. The spark creates the necessary energy to cause localized vaporization of the liquid located between the pair of electrodes 82 and 90. It should be appreciated that the size of the gap 92 between the adjoining ends of the pair of electrodes is critical in this regard.

The sudden vaporization of the liquid in the cavity 74 releases a transient high pressure wave that moves outwardly in the liquid from the gap 92 toward the walls of the cavity 74. The pressure wave distends the flexible wall 100 so that the wall assumes the shape of the outer side of the wheel rim 40. In all other directions, the pressure wave is constrained by the rigid walls of the die halves 70 and 72. The flexible wall 100 is constrained from expansion by the lock rings 96 and 98. Therefore, the wall 100 exerts pressure against the wheel rim 40. Since the wheel rim is itself supported by the inside rim stabilizer 12 and the top die inside rim stabilizer 32, the wall 100 can only push the wheel rim 40 inwardly in the area of the annular concavity 58 of the spider 30.

The pressure wave thus distends the flexible wall or rubber containment bladder in the area of the annular concavity 58 of the spider and pushes the wheel rim portion overlying the annular concavity radially inwardly. The portion of the wheel rim at the annular concavity 58 is displaced in the opposing direction relative to the pressure wave and therefore yields in permanent radial compression to form a continuous circumferential joint between the wheel rim and the spider. As seen in FIG. 1, contact is avoided between the stabilizer 12 and the spider 30 radially inwardly of the joint that is formed between the wheel rim and the spider. The final result creates an integral compressive mechanical interlock between the rim 40 and the spider 30. The pressure wave in the fluid held in the cavity 74 is also transmitted to the fluid contained in the inlet 76 and the outlet 104. However, each of these is sealed off by a respective valve 124 and 126. These valves are conventional on/off valves which may be either actuated manually or automatically via solenoids, air actuators or the like, as desired.

When the electrohydraulic forming process is complete, the fluid is vented from the cavity 74 via valve 126 in order to allow the bladder 100 to be spaced away from the wheel rim 40 as the fluid pressure in the cavity 74 decreases and the normal resilience of the bladder allows it to contract. Then the top die inside rim stabilizer 32 is removed. The knockout rod 20 can then be used in order to lift the now formed wheel away from the high capacity forming machine B.

Figure 5:
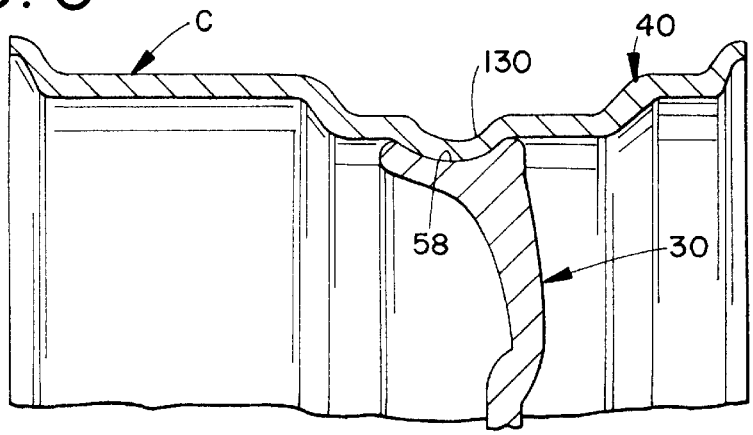
FIG. 5 is a side elevational view in cross section of a portion of the wheel of FIG. 4 after the wheel rim has been secured to the spider.

With reference now to FIG. 5, the final wheel C is there illustrated. The wheel comprises the spider 30 to which the wheel rim 40 is now permanently secured via a compression groove 130 in the area of the annular concavity 58. The necessary required tensile forces to separate the rim and the spider are greater than those used to yield the wheel rim 40 in compression due to strain hardening effects on the metal of the wheel rim.

The wheel joint is stronger than in the prior art methods of assembly due to strain hardening of the wheel rim at the groove 130. Thus the base properties of the wheel rim in the area of the groove 130 are greater than in other regions of the wheel rim 40. Also, at the joint, both the rim 40 and the spider 30 are in radial compression with each other.

There are a number of benefits of the high energy rate forming process illustrated in FIG. 3. First, the spider 30 and the rim 40 can be made of dissimilar materials due to the mechanical locking interface. For example, the material of the spider can be either a metal alloy, such as aluminum, magnesium or steel, or even a non-metallic material whereas the rim is made of a suitable metallic material such as steel.

The inventive joint structure will also lend itself to newer and lighter weight wheel assemblies. New materials with lower density to strength ratios can be introduced into the market thereby enhancing the fuel efficiency of vehicles.

Also, the thickness of the wheel rim can be reduced thereby saving in product weight and material costs.

Both the wheel rim 40 and the spider 30 can be cosmetically finished before their assembly in the high capacity forming machine B illustrated herein. The finished wheel assembly C is advantageous in that the trueness of it is improved because there are no localized thermal gradients in the process of securing the wheel rim to the spider as is the case with the conventional method of welding the wheel rim to the spider. The area of joining of the wheel rim and the spider is not constrained by the reduced material condition associated with welding due to the heat affected zone. The inventive method may also be faster than welding since no cool down is required afterwards.

With a wheel manufactured according to the present invention, there are no non-uniform stress distributions induced as in bolting or riveting. Therefore, the wheel rim and spider joint may be placed anywhere within the rim. This allows for multiple rim and spider offsets as may be advantageous or desirable.

If the wheel rim is damaged, such as by being bent in a pothole or scraped against a curb, it can be replaced without having to replace the spider. This permits a consumer to keep the spider and not have to replace the entire wheel because the spider can be reused.

Rim and spider manufacturing via the electrohydraulic forming method discussed hereinabove can utilize existing manufacturing technology thus permitting a rapid deployment of this invention into the currently employed manufacturing processes.

The energy requirements for the electrohydraulic forming method discussed hereinabove for manufacturing vehicle wheels will depend on the thickness of the wheel rim as well as the material it is made from and the thermal strain hardening characteristics and history of such material. It will also depend on the contact surface area of the wheel rim overlying the annular concavity on the spider, as this is the surface area which is subject to local deformation.

While FIGS. 1–6 herein disclose a method for forming an annular compression groove 130 in a wheel rim in order to secure the wheel rim to the spider, it would be just as conceivable to deform the spider radially outwardly to secure it to the wheel rim. Moreover, while an annular compression groove is illustrated, it would also be conceivable to have several spaced indentations formed in the wheel rim in order to secure the wheel rim to the spider. The specific geometry of the joint between the spider and the wheel rim will depend on the shapes of the wheel rim and spider which are meant to be secured together. All that is important is that at least one of these two elements be permanently deformed in order to bring it into locking engagement with the other element. It would also be possible to simultaneously or sequentially deform both elements, or portions of both elements, in order to permanently secure them together.

It is also contemplated that adhesives, such as epoxy or glue resins, could be used to enhance the strength of the joint between the wheel rim and the spider.

With reference now to FIG. 7, it should be recognized that high energy rate forming processes other than the electrohydraulic forming method and apparatus disclosed in FIGS. 1–6 above can be employed for securing the wheel rim to the spider. Instead, electromagnetic forming can be employed. This process, also known as magnetic pulse forming, converts electrical energy into mechanical energy by means of a magnetic field that exerts a force on a current carrying conductor, namely the metallic workpiece. When an electric current flows through a conductor, such as a length of wire in the magnaforming device, a magnetic field is created that fills the space closely surrounding the conductor. The magnetic field envelops the wire as long as the current flows. As inferred from the ability of a simple bar magnet to either attract or repel a second magnet, magnetic fields possess definite orientations or directions of influence. When a magnetic field is produced by flow of an electric current within a conductor, the direction of the field is derived from the direction of current flow.

If a loop of wire is moved through an existing magnetic field, an electric current is generated in the wire loop because of the phenomenon known as induction. That same induction effect occurs if, instead, the wire loop is held stationary while the source of the field is moved closely past the loop causing proximate relative motion to occur again between the loop and the field. When the source of the magnetic field is an electromagnet, the field producing current is usually called the primary current and the induced current can be called the secondary or eddy current, or even the image current. Each of the two electric currents, the primary in the magnaforming device and the induced in the wheel rim, establishes its own magnetic field. However, because the primary and the induced currents flow in opposite directions, the magnetic fields established will be oriented in opposite directions. This will cause a repelling force between the magnetic field formed around the wire loop in the magnaforming device and the magnetic field induced in the wheel rim. This, then, will exert a pressure on the wheel rim in the area of the annular concavity, the only area of the wheel rim not constrained by the inside wheel rim stabilizers, to form a groove in the wheel rim at the annular concavity thus securing the wheel rim to the spider.

In FIG. 7 is illustrated a high capacity forming machine D, which comprises a coil housing and magnetic shield 140 having therein an insulation layer 142 and disposed radially inwardly therefrom a fiberglass reinforcement layer 144. Disposed radially inwardly from the reinforcement layer 144 is a primary winding 146 which may comprise four spaced loops of wire. Radially inwardly from the windings there is disposed a coil body 148. If desired, a field shaper 152 can be located radially inwardly of the body 148. The field shaper can comprise two spaced toroidal halves 154 and 156 which enable the field shaper 152 to be separated when necessary, such as in order to release an assembled vehicle wheel.

The invention has been described with reference to several embodiments. Obviously, modifications and alterations will occur to others upon the reading and understanding of this specification. It is intended to include all such modifications and alterations insofar as they come within the scope of the appended claims or the equivalents thereof.

What is claimed is:

1. An apparatus for securing a wheel rim to a spider comprising:

a high capacity forming machine configured to encircle an associated wheel rim and an associated spider positioned adjacent the associated wheel rim;

an electromagnetic coil body located in said high capacity forming machine and positioned radially outwardly of the associated wheel rim;

a capacitor bank electrically connected to said coil body;

a field shaping body encircling the associated wheel rim and positioned radially inwardly of said electromagnetic coil body; and, a die assembly for holding the associated wheel rim in said high capacity forming machine, wherein said die assembly comprises a pair of spaced stabilizers for supporting different surfaces of the associated wheel rim.

2. The apparatus of claim 1 further comprising a switching circuit electrically connected between said capacitor bank and said electromagnetic coil body for regulating a discharge of electricity from said capacitor bank into said electromagnetic coil body.

3. The apparatus of claim 2 wherein said high capacity forming machine further comprises:

a sensing circuit which receives information from said capacitor bank;

a control circuit which receives information from said sensing circuit;

a charging circuit which receives information from said control circuit; and, a limit and safety circuit which is regulated by said charging circuit and provides information to said control circuit.

4. The apparatus of claim 1 wherein said die assembly further comprises:

a bottom die; and wherein said pair of spaced stabilizers comprise a bottom inside rim stabilizer supported by said bottom die; and a top inside rim stabilizer located above said bottom inside rim stabilizer.

5. An apparatus for securing a wheel rim to a spider comprising:

a high capacity forming machine configured to encircle an associated wheel rim and an associated spider positioned adjacent the associated wheel rim;

an electromagnetic coil body located in said high capacity forming machine and positioned radially outwardly of the associated wheel rim;

a die assembly for supporting the associated wheel rim in said high capacity forming machine wherein said die assembly comprises:

a bottom die, a bottom inside rim stabilizer supported by said bottom die, and a top inside rim stabilizer located above said bottom inside rim stabilizer; and, a field shaping body encircling the associated wheel rim and positioned radially inwardly of said electromagnetic coil body.

6. The apparatus of claim 5 further comprising a capacitor bank electrically connected to said coil body.

7. The apparatus of claim 6 further comprising a switching circuit electrically connected between said capacitor bank and said electromagnetic coil body for regulating a discharge of electricity from said capacitor bank into said electromagnetic coil body.

8. The apparatus of claim 7 wherein said high capacity forming machine further comprises:

a sensing circuit which receives information from said capacitor bank;

a control circuit which receives information from said sensing circuit;

a charging circuit which receives information from said control circuit; and, a limit and safety circuit which is regulated by said charging circuit and provides information to said control circuit.

9. An apparatus for securing a wheel rim to a spider comprising:

a high capacity forming machine configured to encircle an associated wheel rim and an associated spider positioned adjacent the associated wheel rim;

a die assembly for supporting the associated wheel rim in said high capacity forming machine, said die assembly comprising at least two elements located on opposed sides of the associated wheel rim; and, a field shaping body encircling an indented portion of the associated wheel rim.

10. The apparatus of claim 9 wherein said die assembly further comprises:

a bottom die and wherein said at least two elements comprise:

a bottom inside rim stabilizer supported by said bottom die; and a top inside rim stabilizer located above said bottom inside rim stabilizer.

11. The apparatus of claim 9 further comprising:

an electromagnetic coil body located in said high capacity forming machine; and, a capacitor bank electrically connected to said coil body.

12. The apparatus of claim 10 further comprising a switching circuit electrically connected between said capacitor bank and said electromagnetic coil body for regulating a discharge of electricity from said capacitor bank into said electromagnetic coil body.

13. The apparatus of claim 12 wherein said high capacity forming machine further comprises:

a sensing circuit which receives information from said capacitor bank;

a control circuit which receives information from said sensing circuit;

a charging circuit which receives information from said control circuit; and, a limit and safety circuit which is regulated by said charging circuit and provides information to said control circuit.

* * * * *